US006579003B2

(12) United States Patent
Glick et al.

(10) Patent No.: US 6,579,003 B2
(45) Date of Patent: Jun. 17, 2003

(54) DECORATIVE HOURGLASS WITH LIGHT REFLECTING BASE

(75) Inventors: Louis Glick, NY, NY (US); Stanley Zale, NY, NY (US)

(73) Assignee: Louis Glick Diamond Corp., New York, NY (US)

( * ) Notice: Subject to any disclaimer, the term of this patent is extended or adjusted under 35 U.S.C. 154(b) by 0 days.

(21) Appl. No.: 09/838,775

(22) Filed: Apr. 17, 2001

(65) Prior Publication Data

US 2002/0150000 A1 Oct. 17, 2002

(51) Int. Cl.[7] ..... G04F 1/04; G04B 19/30
(52) U.S. Cl. ..... 368/93; 368/95; 368/227
(58) Field of Search ..... 368/93, 95, 67, 368/91, 227, 256

(56) References Cited

U.S. PATENT DOCUMENTS

| | | | | |
|---|---|---|---|---|
| 2,644,890 A | | 7/1953 | Hollihan | |
| 3,724,847 A | | 4/1973 | Compton | |
| 3,935,702 A | | 2/1976 | Tamada | |
| 4,267,588 A | * | 5/1981 | Daniels | 368/93 |
| 4,474,481 A | | 10/1984 | Croyle | |
| 4,648,721 A | | 3/1987 | Shapiro | |
| 5,117,405 A | | 5/1992 | Thibault | |
| 5,122,994 A | * | 6/1992 | Benedetti | 368/93 |
| 5,528,561 A | * | 6/1996 | Castanis | 368/93 |
| 5,926,440 A | * | 7/1999 | Chien | 368/10 |

FOREIGN PATENT DOCUMENTS

| | | |
|---|---|---|
| DE | 2514777 | 10/1976 |
| JP | 58-150882 | 9/1983 |
| JP | 58-150883 | 9/1983 |

* cited by examiner

*Primary Examiner*—David Martin
*Assistant Examiner*—Michael L. Lindinger
(74) *Attorney, Agent, or Firm*—Stephen E. Feldman

(57) ABSTRACT

An hourglass timepiece that is filled with a plurality of precious or semi-precious stones, such as small uncut diamonds, which are suspended in a silicone compound, such as silicone oil, to prevent scratching of the interior surface of the hourglass as the stones move by gravity from an upper compartment to a lower compartment of the hourglass. The hourglass has similar ends, either of which can be supported by a decorative base that reflects light into the stones to highlight them and compensate for the reflective loss due to the silicone.

21 Claims, 3 Drawing Sheets

DECORATIVE HOURGLASS WITH LIGHT REFLECTING BASE

FIELD OF THE INVENTION

The present invention is directed to a decorative timepiece, such as an hourglass, that is filled with silicone and precious or semi-precious stones for measuring time. The silicone operates as both a lubricant and a protective agent to enable coarse stones, such as uncut diamonds, to be used to measure the passage of time by descending from an upper compartment to a lower compartment of the hourglass. Furthermore, the silicone acts as an agent slowing the rate of flow of stones, and, thus, lengthening the time measured by the hourglass of the present invention. The hourglass has identical or nearly identical upper and lower ends which each fit into a light reflecting decorative base which highlights the.diamonds as they move downwardly through the hourglass.

BACKGROUND OF THE INVENTION

There are a variety of known hourglasses for measuring the passage of time. These hourglasses implement the movement of fine granules as a means of measuring time. However, as will be seen below, these hourglasses present several problems that the hourglass of the present invention seeks to overcome.

An hourglass is a known timing device that is used to measure the passage of short periods of time. Generally, an hourglass has two hollow compartments that are separated by a narrow passageway. The narrow passageway is usually smaller in diameter than the diameters either of the two respective hollow compartments. When properly positioned, one compartment of the hourglass is situated on top of the other. The hourglass is filled with fine granules, such as sand, for measuring the passage of time. The granules are capable of passing through the passageway. When all of the granules are resting in the lower compartment, the hourglass is inverted to begin the period of time to be measured. The fine granules flow from the upper compartment, through the passageway, and into the lower compartment. The granules flow through the hourglass due to the force of gravity. When all of the granules reach the bottom compartment, the time being measured elapses. This is a well-known method for measuring the passage of time.

The amount of time that an hourglass may measure varies according to several factors, including, the width of the passageway, the size and weight of the granules and the amount of granules used. Since the passageway is usually narrow, coarse granules are likely to become lodged therein and block the flow of granules. Accordingly, most hourglasses use dry fine granules, such as sand, to ensure that the time being measured remains uninterrupted.

Previous hourglasses used fine granules because they did not damage the inner surface of the hourglass. Coarse objects, on the other hand, tend to damage the inner surface of the hourglass. As a result, the hourglass may crack or be otherwise damaged. This is particularly true where abrasive objects, such as uncut diamonds, are used as granules. It is known to add lubricating viscous liquid to the interior of the hourglass but this can inhibit the visibility of the granules as they move downwardly in the hourglass. There is a long felt need for an hourglass that implements the use of precious or semi-precious stones, such as uncut diamonds, suspended in a liquid while maintaining the visibility of the diamonds inside of the hourglass. The present invention seeks to solve this long felt need.

U.S. Pat. No. 3,935,702 to Tamada discloses an hourglass filled with a transparent liquid, such as water, for preventing the granules from being electrostatically charged. However, Tamada does not address the particular need to provide a lubricant, such as silicone, to improve the flow of large, coarse granules through an hourglass, nor does Tamada teach maintaining or improving the visibility of granules inside an hourglass. The present invention seeks to overcome the problems of Tamada's patent by implementing silicone along with a light-reflecting base that offsets the disadvantages of silicone.

While known hourglasses are of interest, they do not address the particular needs that arise when coarse granules, such as uncut diamonds, are used in conjunction with silicone lubricant to measure the passage of time. The present invention addresses this need.

SUMMARY OF THE INVENTION

The present invention is directed toward an hourglass, wherein precious or semi-precious stones, such as uncut diamonds, are used in conjunction with a liquid silicone to measure the passage of time. The silicone operates as both a lubricating agent and a protective layer. The silicone also lengthens the time to be measured by slowing the rate of flow of granules in the hourglass, but the silicone liquid interferes with visibility and makes it more difficult to see and appreciate the beauty of the diamonds. In this invention, a reflecting base holding the hourglass in an upright position assists in visibility of the diamonds.

It is an object of this invention to provide an hourglass having silicone and precious or semi-precious stones such as uncut diamonds, as a means for measuring the passage of time, with a light reflecting base that gives improved visibility of the diamonds.

Another object of the present invention is to lengthen the time to be measured by an hourglass through the use of liquid silicone, while at the same time improving the visibility through the silicone.

Other objects will become apparent from the foregoing description.

BRIEF DESCRIPTION OF THE DRAWINGS

The following description of preferred embodiments of the present invention will be better understood when read in conjunction with the appended drawings. It should be understood, however, that the invention is not limited to the precise arrangements shown in which.

DESCRIPTION OF THE PREFERRED EMBODIMENT

Figure 1:
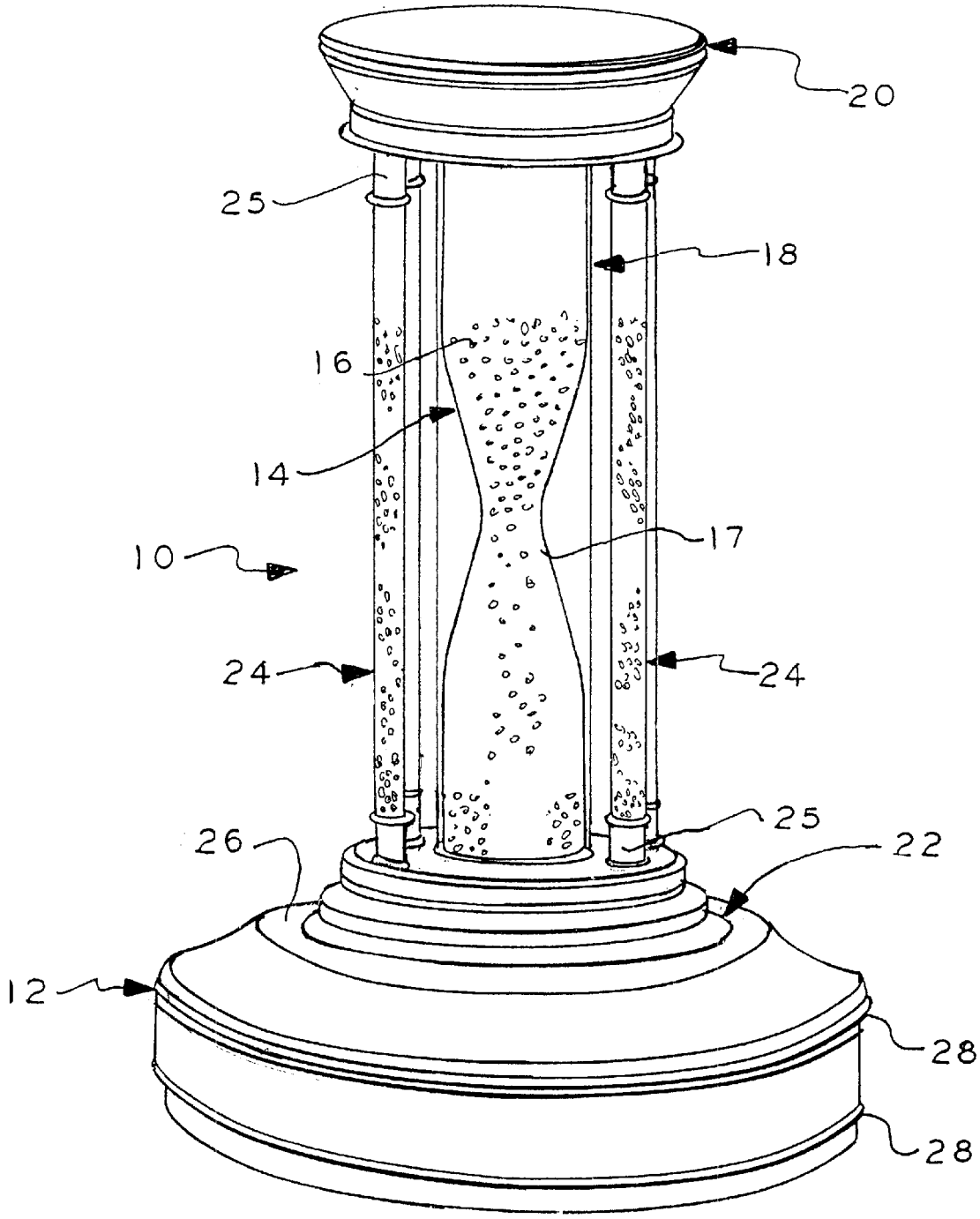
FIG. 1 is a perspective front elevational view of the hourglass of the present invention assembled on its base.

The present invention is directed to an hourglass 10 that is partially filled with a plurality of small precious or semi-precious stones 16 which are suspended in a dens liquid 17. The hourglass has an inner hourglass shaped transparent body 14 which is preferably made of quartz glass to be more resistant to any scratching by movement of the precious or semi-precious stones 16. The body 14 is encased in a glass cylinder 18 whose top and bottom ends are enclosed by first end plate 22 and second plate 20. These end plates are substantially identical and are of similar size and shape so that either end plate may be received in and held by or on decorative base 12.

End plates 22 and 20 may be secured to opposite ends of transparent body 14 and/or opposite ends of glass cylinder 18 by any convenient means such as an adhesive and preferably an adhesive which does not completely harden but remains resilient to lessen impact shocks to the glass cylinder and transparent hourglass body. End plates 22 and 20 are preferably also held together by a plurality of pillars 24 which have ferrules 25. Preferably there are three or four pillars 24 which serve several purposes: to maintain consistent spacing between end plates 20 and 22; to protect the glass cylinder 18 against breakage and to add decorative effect to the hourglass as will be later explained in greater detail.

Figure 2:
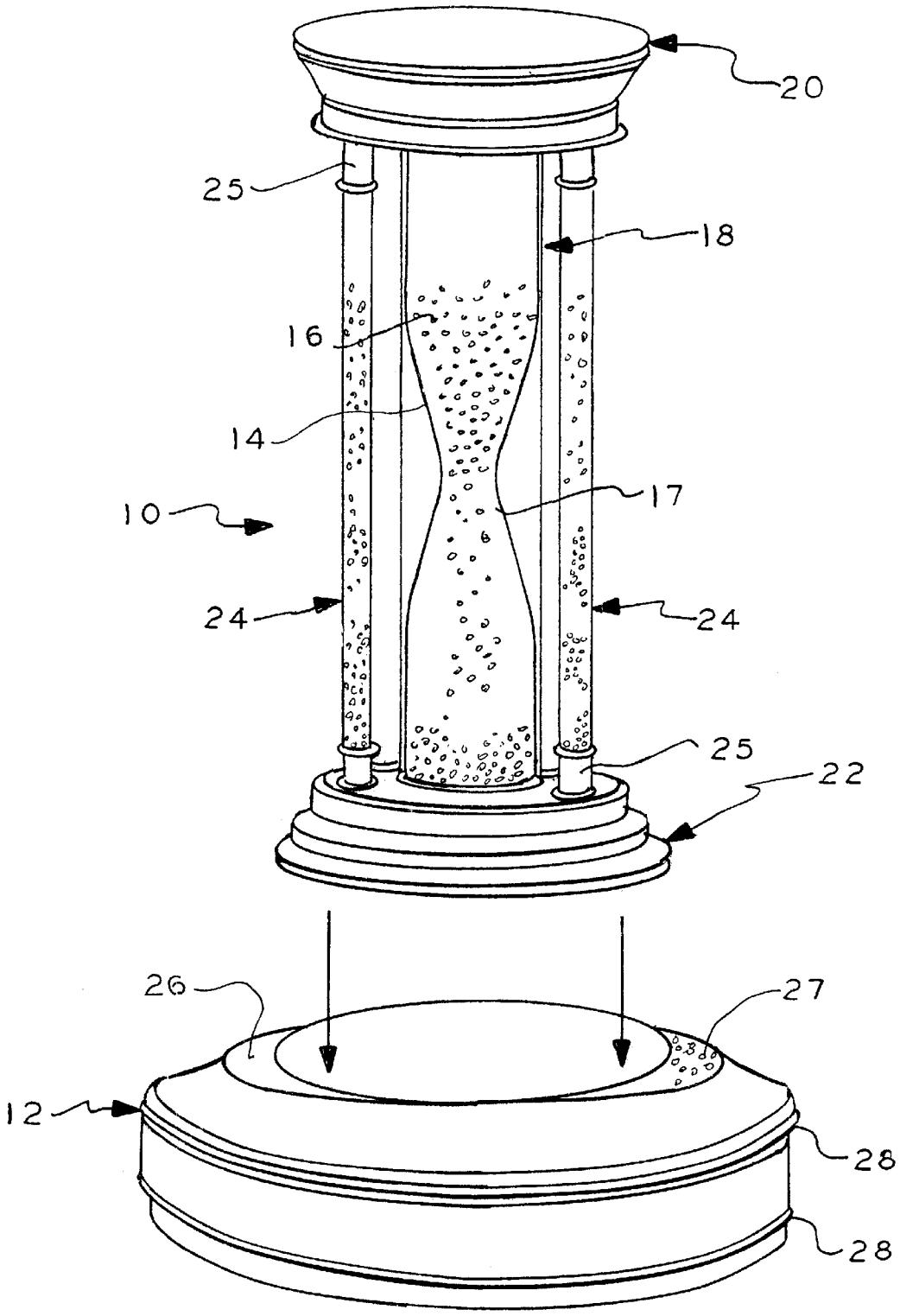
FIG. 2 is a view similar to FIG. 1 with the hourglass removed from its base and showing precious or semi-precious stones in the pillars and in the hourglass.
Figure 3:
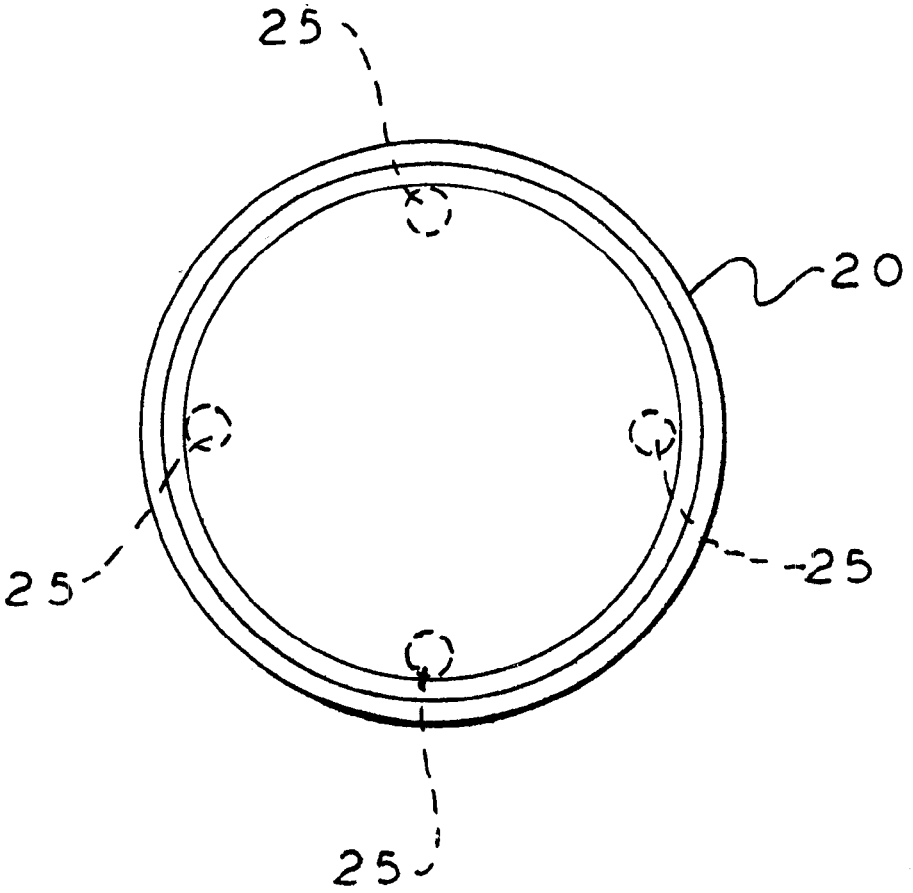
FIG. 3 is a top view of one of the end plates of the hourglass of the present invention.

The pillars 24 are preferably elongated hollow tubular bodies at least one of which also contains a liquid which, as shown in FIG. 2, suspends a plurality of small precious or semi-precious stone, such as uncut diamonds. In case uncut diamonds are used, it is preferable that pillars 24 be made of quartz glass in a manner similar to that of the transparent body 14. It is also preferable that the glass of the pillars be tinted for decorative effect.

The pillars are preferably circumferentially equally spaced apart to add symmetry to the hourglass. The pillars also have the same radial spacing outward from the glass cylinder 18. The liquid in the pillars 24 may be of the same density as the liquid in the transparent body so the precious or semi-precious stones therein will descend downwardly in typical hourglass fashion when the hour glass is inverted. However, because there is no constriction in the pillars 24 the stones would descend at a more rapid rate when the hourglass is inverted, so a more dense liquid may be desirable.

The transparent tubular material of the pillars 24 may be a plastic material or preferably glass and more preferably quartz glass. It is contemplated that this material may be tinted a color which would complement or contrast with the color of the diamonds. For example, a blue colored pillar has been found to complement most diamonds. This effect can be increased by an arrangement to have light projecting from the one or more of the pillars by means of a fiber optic filament running through the pillar and actuated by a light source 28 in the base 12.

As previously stated, one of the purposes of the base is to reflect light upwardly to enhance the beauty of the diamonds. This can be accomplished by the shape of the concave reflecting surface 26 on the upper portion of the base 12. As shown in FIGS. 1 and 2, this surface is located beneath and spaced radially outward from the hourglass so that light rays striking it will be reflected upward and directly into the hourglass, thus illuminating the diamonds from a different angle and highlighting their effect. Various light enhancing effects are contemplated, for example if the surface 26 has a plurality of small indentations, each such indentation can act as a small reflector to concentrate light on a specific portion of the hourglass. This is shown diagramatically in FIG. 2 where a portion is shown with indentations 27. It is also contemplated that surface 26 be a smoothly polished silver reflecting surface to enhance the beauty of the base as well as to reflect upwardly. Another enhancement can be a light source in the base such as a small electric light bulb powered either by a self contained battery or by an outside power source delivered by an electric cord extending from the base.

While the invention has been described with reference to specific embodiments and reference to drawings, this is for convenience and clarity. No unnecessary limitations are to be implied beyond the requirements of the prior art because such terms are intended to be broadly construed. The description is by way of example and the scope of the invention is not to be limited to the exact details shown, represented or described.

What is claimed is:

1. An hourglass time measuring device comprising an hourglass shaped transparent body having a closed interior volume containing a plurality of small precious of semi-precious stones suspended in a liquid of sufficient viscosity to act as a lubricant between said stones and inner walls of said transparent body;

said liquid having a specific gravity less than that of said precious or semi-precious stones so said stones can fall by gravity to a bottom of said hour glass body;

said transparent body having first and second ends, each said end having an end plate thereover, said end plates being of similar shape and size;

a base for holding either of said end plates to support said transparent body in a generally vertical position so that said transparent body may be inverted with either end in a downward position on said base;

said base having a light reflecting exterior surface on at least a portion thereof and shaped to reflect light toward said precious or semi-precious stones in said transparent body.

2. The hourglass of claim 1 in which said precious or semi-precious stones are diamonds.

3. The hourglass of claim 2 in which said diamonds are uncut diamonds of approximately one-half karate in size.

4. The hourglass of claim 1 in which said transparent body comprises quartz glass.

5. The hourglass of claim 1 in which said liquid is a silicone.

6. The hourglass of claim 4 in which said silicone is a silicone oil.

7. The hourglass of claim 1 including a plurality of pillars extending between said end plate, said end plates being positioned to hold said end plates in fixed relation to each other, said pillars being equally circumferentially spaced apart around the transparent body.

8. The hourglass of claim 7 in which said pillars are elongated hollow tubular bodies.

9. The hourglass of claim 8 in which in at least one of the hollow tubular bodies is transparent and contains precious or semi-precious stones suspended in a liquid so they can move when the hourglass is inverted.

10. The hourglass of claim 9 in which said at least one hollow tubular body which contains precious or semi-precious stones has a liquid of a different viscosity than the viscosity of the liquid in the transparent body so that the stones therein descend at a rate different than the descent rate in the transparent body.

11. The hourglass of claim 10 in which the density of the stones and the density of the liquid is selected so the stones fall slowly downward when the hourglass is inverted.

12. The hourglass of claim 11 in which the density of the stones is relation to the density of the liquid is selected so a rate of descent of the stones in the hollow tubular body is greater than a rate of descent of the stones in the transparent body.

13. The hourglass of claim 11 in which the density of the stones in relation to the density of the liquid is selected so a rate of descent of the stones in the hollow tubular body is less than a rate of descent of the stones in the transparent body.

14. The hourglass of claim 7 in which the pillars are colored to accent and highlight said precious or semi-precious stones.

15. The hourglass of claim 14 in which the pillars are lighted from a power source in said base.

16. The hourglass of claim 1 in which an upper surface of said base is a light-reflecting surface and is concavely shaped to reflect light upwardly and toward the precious or semi-precious stones in the transparent body.

17. The hourglass of claim 16 in which at least an upper surface of the base comprises a silver colored metal.

18. An hourglass time measuring device comprising:

an hourglass shaped transparent body having a closed interior volume containing a plurality of uncut diamonds suspended in a dense liquid of sufficient viscosity to act as a lubricant between said diamonds and inner walls of said transparent body;

said transparent body having first and second ends, each end having an end plate thereover, said end plates being of similar size and shape;

a plurality of pillars extending between said end plates and secured thereto to hold said end plates in fixed relation to each other, said pillars being equally circumferentially spaced around the transparent body;

a base for holding either of said end plates to support said transparent body in a generally vertical position so that said transparent body may be inverted with either end in a downward position on said base;

said base having a light reflecting exterior surface on at least and upper portion thereof, said upper portion being concavely shaped to reflect light toward said uncut diamonds in said transparent body.

19. The hourglass of claim 18 in which at least one of said pillars is a hollow tubular body containing a second plurality of precious or semi-precious stones suspended in a liquid with the density of the stones in relation to the density of the liquid being selected so a rate of descent of the stones when the hour glass is inverted is greater than a rate of descent of the stones in the transparent body.

20. The hourglass of claim 18 in which at least one of said pillars is a hollow tubular body containing a plurality of precious or semi-precious stones suspended in a liquid with the density of the stones in relation to the density of the liquid being selected so a rate of descent of the stones when the hourglass is inverted is less than a rate of descent of the stones in the transparent body.

21. The hourglass of claim 18 in which a portion of said concavely shaped light reflecting surface has a plurality of indentations to concentrate reflection of a light on a specific portion of said precious or semi-precious stones.

* * * * *